US011674680B2

(12) United States Patent
Wu

(10) Patent No.: US 11,674,680 B2
(45) Date of Patent: Jun. 13, 2023

(54) LIGHT SOURCE DEVICE

(71) Applicant: HOYA CORPORATION, Tokyo (JP)

(72) Inventor: Lisong Wu, Tokyo (JP)

(73) Assignee: HOYA CORPORATION, Tokyo (JP)

( * ) Notice: Subject to any disclaimer, the term of this patent is extended or adjusted under 35 U.S.C. 154(b) by 10 days.

(21) Appl. No.: 17/618,422

(22) PCT Filed: Jun. 12, 2020

(86) PCT No.: PCT/JP2020/023311

§ 371 (c)(1),
(2) Date: Dec. 10, 2021

(87) PCT Pub. No.: WO2020/251048

PCT Pub. Date: Dec. 17, 2020

(65) Prior Publication Data

US 2022/0349567 A1 Nov. 3, 2022

(30) Foreign Application Priority Data

Jun. 13, 2019 (JP) ..... JP2019-110338

(51) Int. Cl.
*F21V 29/61* (2015.01)
*F21V 29/503* (2015.01)
(Continued)

(52) U.S. Cl.
CPC ..... *F21V 29/61* (2015.01); *F21V 29/503* (2015.01); *F21V 29/67* (2015.01);
(Continued)

(58) Field of Classification Search
CPC ..... F21V 29/61; F21V 29/503; F21V 29/67; F21V 29/00; F21V 29/50; F21V 29/502;
(Continued)

(56) References Cited

U.S. PATENT DOCUMENTS 10,006,619 B1 * 6/2018 Niemiec ..... F21V 3/049
2009/0038787 A1 * 2/2009 Lu ..... F21V 29/61 353/57

(Continued)

FOREIGN PATENT DOCUMENTS

JP 2006147373 A 6/2006
JP 2007087816 A 4/2007

(Continued)

*Primary Examiner* — Bao Q Truong
(74) *Attorney, Agent, or Firm* — Rabin & Berdo, P.C.

(57) ABSTRACT

Provided is a light source device in which the housing is not full of heat, and the risk of inhaling dust in the housing or the risk of reduction of life of the fan device becomes reduced. In an aspect, a light source device according to the present disclosure includes a light source; a light source control unit for controlling turning on/off and a quantity of light of the light source; a cooling fan for cooling the light source; and a fan control unit for controlling a number of revolutions of the cooling fan, wherein the fan control unit is configured to: control the number of revolutions of the cooling fan to become a first number of revolutions depending on the quantity of light of the light source when the light source is turned on, and control the number of revolutions of the cooling fan to become a second number of revolutions lower than the first number of revolutions by waiting for a predetermined waiting time when the light source is turned off.

15 Claims, 8 Drawing Sheets

(51) Int. Cl.

| | |
|---|---|
| ***F21V 29/67*** | (2015.01) |
| *F21Y 115/10* | (2016.01) |
| *B41J 11/00* | (2006.01) |
| *B41J 29/377* | (2006.01) |

(52) U.S. Cl.
CPC ..... *B41J 11/00214* (2021.01); *B41J 11/00218* (2021.01); *B41J 29/377* (2013.01); *F21Y 2115/10* (2016.08)

(58) Field of Classification Search
CPC ..... F21V 29/60; F21V 23/00; F21V 23/003; F21V 23/0442; F21V 23/04; F21Y 2115/10; B41J 11/00218; B41J 11/00214; B41J 29/377; B41J 2/01; B41J 29/38; B05D 3/067; B41F 23/045; F21D 1/00; H01L 33/64
See application file for complete search history.

(56) References Cited

U.S. PATENT DOCUMENTS

| | | | | |
|---|---|---|---|---|
| 2009/0160344 | A1* | 6/2009 | Hsu | F21K 9/00 315/117 |
| 2010/0308732 | A1* | 12/2010 | Lye | F21K 9/00 315/113 |
| 2013/0128457 | A1* | 5/2013 | Shioya | G03B 21/16 361/695 |
| 2016/0334091 | A1* | 11/2016 | Kim | F21V 29/61 |
| 2019/0200430 | A1* | 6/2019 | Uchida | F21V 29/61 |

FOREIGN PATENT DOCUMENTS

| | | | |
|---|---|---|---|
| JP | 2010197500 | A | 9/2010 |
| JP | 6349098 | B2 | 6/2018 |

* cited by examiner

LIGHT SOURCE DEVICE

BACKGROUND OF THE DISCLOSURE

Field of the Disclosure

The present disclosure relates to a light source device that emits light and, more particularly, to a light source device including a cooling fan for cooling heat emitted from the light source.

Related Art

Conventionally, a printing apparatus for printing, which uses UV ink cured by irradiating a target with ultraviolet light, is known. Such a printing apparatus is provided with an ultraviolet ray irradiating device and configured to discharge ink on a medium from a nozzle of a head and irradiate ultraviolet light on dots formed on the medium. As a light source for the ultraviolet ray irradiating device, a plurality of ultraviolet LEDs is used (e.g., Patent document 1).

The ultraviolet ray irradiating device disclosed in Patent document 1 is provided with an ultraviolet ray irradiation head having a plurality of ultraviolet LED elements as a light source and a control unit for lighting control of the LED element. As such, when the LED is used for a light source, since most of the power input is transformed to heat, a problem occurs in that lighting efficiency and life of the LED element become deteriorated by the heat emitted from the LED element itself. Furthermore, the problem becomes serious considering the fact that the number of LED elements, which are a heat source, is increased when a plurality of LED elements is mounted in the ultraviolet ray irradiating device disclosed in Patent document 1. For this reason, the ultraviolet ray irradiating device disclosed in Patent document 1 is provided with a heat sink for transferring heat generated in the LED element efficiently and a plurality of fan devices that provides cooling air to the heat sink and drives the fan device simultaneously with turning on the LED element and stops the fan device simultaneously with turning off the LED element, thereby suppressing heat dissipation of the LED element.

PRIOR ART DOCUMENT

Patent document 1: Japanese patent No. 6349098

SUMMARY

According to the ultraviolet ray irradiating device disclosed in Patent document 1, the heat dissipation from the LED element can be suppressed by driving control of the fan device. However, the ultraviolet ray irradiating device disclosed in Patent document 1 drives the fan device simultaneously with turning on the LED element and stops the fan device simultaneously with turning off the LED element, and the housing of the ultraviolet ray irradiating device becomes full of heat when the LED element is turned off, and thus, there is a problem in that the housing is not cooled more although the LED element is turned off. In addition, when the LED element is turned on, the fan device rotates in the maximum number of revolutions always when the LED element is turned on, so it is easy to inhale dust from an intake hole (or fan device) and the risk of breakdown becomes increased. Furthermore, when the time for the fan device to rotate in the maximum number of revolutions increases, the life of the fan device becomes shorter.

In order to solve the problem above, the present disclosure is to provide a light source device which is capable of suppressing the state that the housing is full of heat when the LED element is turned off and reducing the risk of inhaling dust into the housing or the risk of reduction of life of the fan device.

In an aspect, a light source device according to the present disclosure includes a light source; a light source control unit for controlling turning on/off and a quantity of light of the light source; a cooling fan for cooling the light source; and a fan control unit for controlling a number of revolutions of the cooling fan, wherein the fan control unit is configured to: control the number of revolutions of the cooling fan to become a first number of revolutions depending on the quantity of light of the light source when the light source is turned on, and control the number of revolutions of the cooling fan to become a second number of revolutions lower than the first number of revolutions by waiting for a predetermined waiting time when the light source is turned off.

According to the configuration, since the fan continuously rotates even when the light source is turned off, there is no case that a housing is full of heat. In addition, since the number of revolutions of the fan is decreased while the light source is turned off, the risk of inhaling dust into the housing or the risk of reduction of life of the cooling fan becomes reduced.

In another aspect, a light source device according to the present disclosure includes a light source; a light source control unit for controlling turning on/off of the light source; a cooling fan for cooling the light source; and a fan control unit for controlling a number of revolutions of the cooling fan based on turning on/off of the light source, wherein the fan control unit is configured to: control the number of revolutions of the cooling fan to become a first number of revolutions when the light source is turned on, and control the number of revolutions of the cooling fan to become a second number of revolutions lower than the first number of revolutions by waiting for a predetermined waiting time when the light source is turned off.

In still another aspect, a light source device according to the present disclosure includes a light source; a light source control unit for controlling turning on/off of the light source; a temperature sensor for detecting a temperature of the light source; a cooling fan for cooling the light source; and a fan control unit for controlling a number of revolutions of the cooling fan based on turning on/off of the light source and a detection result of the temperature sensor, wherein the fan control unit is configured to: control the number of revolutions of the cooling fan to become a first number of revolutions when the light source is turned on, and control the number of revolutions of the cooling fan to become a second number of revolutions lower than the first number of revolutions by waiting until the result of the temperature sensor becomes a predetermined value or smaller when the light source is turned off.

In addition, preferably, the fan control unit controls the number of revolutions of the cooling fan to satisfy Conditional equation 1 below when the first number of revolutions is R1, the second number of revolutions is R2, and a transition time from the first number of revolutions to the second number of revolutions is T.

$$(R2-R1)/T=k \quad (k \text{ is an arbitrary constant}) \qquad \text{[Conditional equation 1]}$$

In addition, preferably, when the light source is turned on within the transition time, the fan control unit does not wait for the transition time to be lapsed and controls the cooling fan such that the number of revolutions becomes the first number of revolutions.

In addition, preferably, the fan control unit controls the number of revolutions of the cooling fan to satisfy Conditional equation 2 below when the first number of revolutions is R1 and the quantity of light of the light source is P.

$R1=a\cdot P+b$ ($a$ and $b$ are arbitrary constants) [Conditional equation 2]

In addition, preferably, the second number of revolutions is set to about 40% of a maximum number of revolutions of the cooling fan.

Advantageous Effects

According to the present disclosure, a light source device is realized, in which the housing is not full of heat when the LED element is turned off, and the risk of inhaling dust into the housing or the risk of reduction of life of the fan device becomes reduced.

DESCRIPTION OF EXEMPLARY EMBODIMENTS

Figure 1:
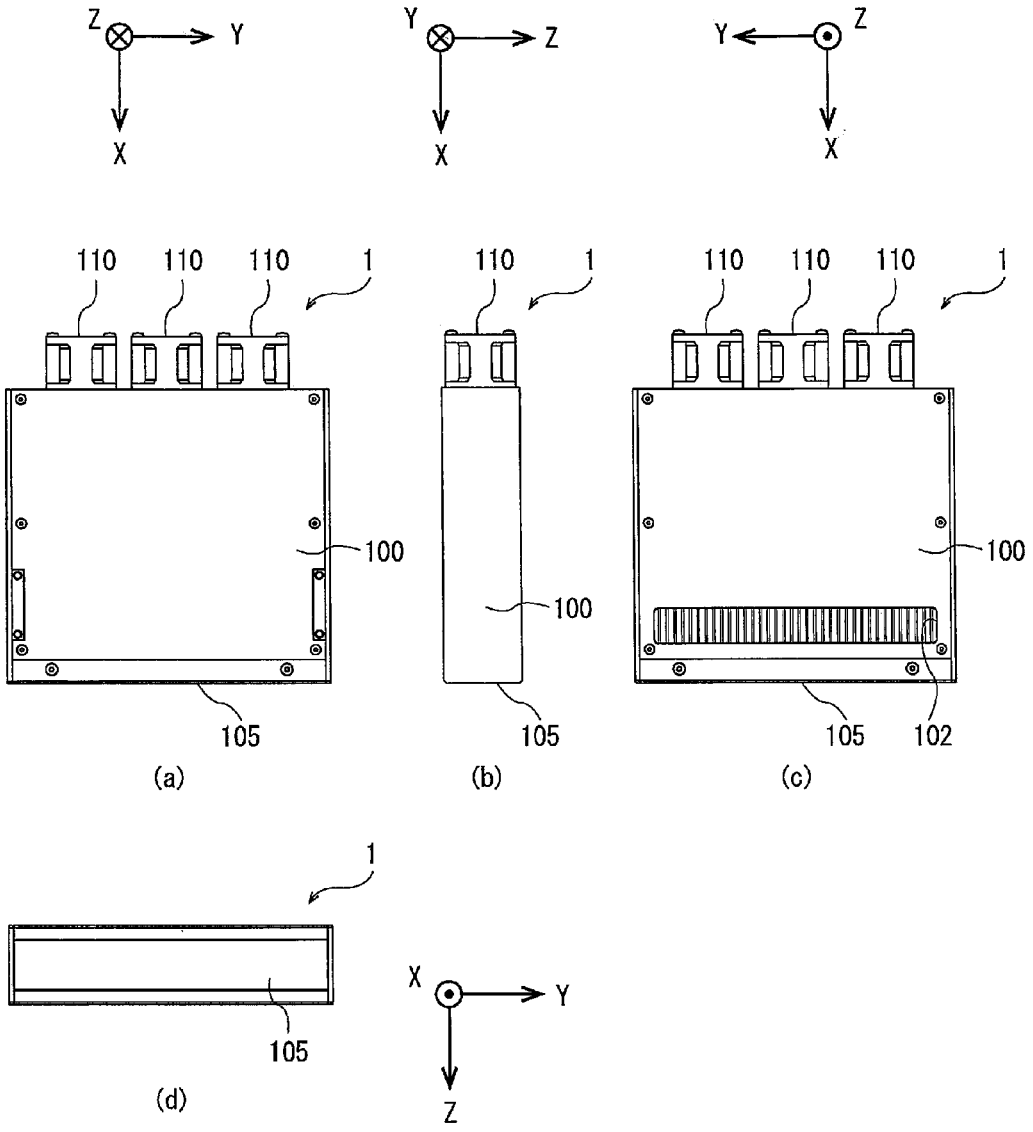
FIG. 1 is an exterior view illustrating a light emitting device according to an exemplary embodiment of the present disclosure.

Hereinafter, the embodiments of the present disclosure will be described with reference to drawings in detail. In addition, the same reference numeral is attached to the same or corresponding part in the drawings, and the description will not be repeated.

FIG. 1 is an exterior view illustrating a light emitting device (light resource apparatus) 1 according to an exemplary embodiment of the present disclosure, and FIG. 1(*a*) is a top plan view of the light emitting device (light resource apparatus) 1 according to an exemplary embodiment of the present disclosure. Further, FIG. 1(*b*) is a right side view of the light emitting device (light resource apparatus) 1 of FIG. 1(*a*), FIG. 1(*c*) is a bottom view of the light emitting device (light resource apparatus) 1 of FIG. 1(*a*), and FIG. 1(*d*) is a front view of the light emitting device (light resource apparatus) 1 of FIG. 1(*a*). The light emitting device 1 according to an exemplary embodiment is a light resource apparatus mounted on a printing apparatus and cures ultraviolet ray curing ink or ultraviolet ray curing resin. The light emitting device 1 is disposed on an upper direction of a target object and emits an ultraviolet ray in a line shape on the target object. In the present disclosure, as shown in the coordinate of FIG. 1, the direction of emitting an ultraviolet ray from a Light Emitting Diode (LED) element 210 to be described below is defined as an X direction, the direction of an arrangement of the LED 210 is defined as a Y direction, and the direction orthogonal to the X direction and the Y direction is defined as a Z direction.

As shown in FIG. 1, the light emitting device 1 according to an exemplary embodiment is provided with a case (housing) 100 of a thin box shape that accommodates a light source unit 200 or a heat sink member 400, a window part 105 attached to a front surface of the case 100 and made of glass through which an ultraviolet ray is emitted, and three fans (cooling fans) 110 installed on a rear surface of the case 100 which exhausts air in the case 100. Further, an intake hole 102 that intakes air from exterior is formed on a bottom surface of the case 100.

Figure 2:
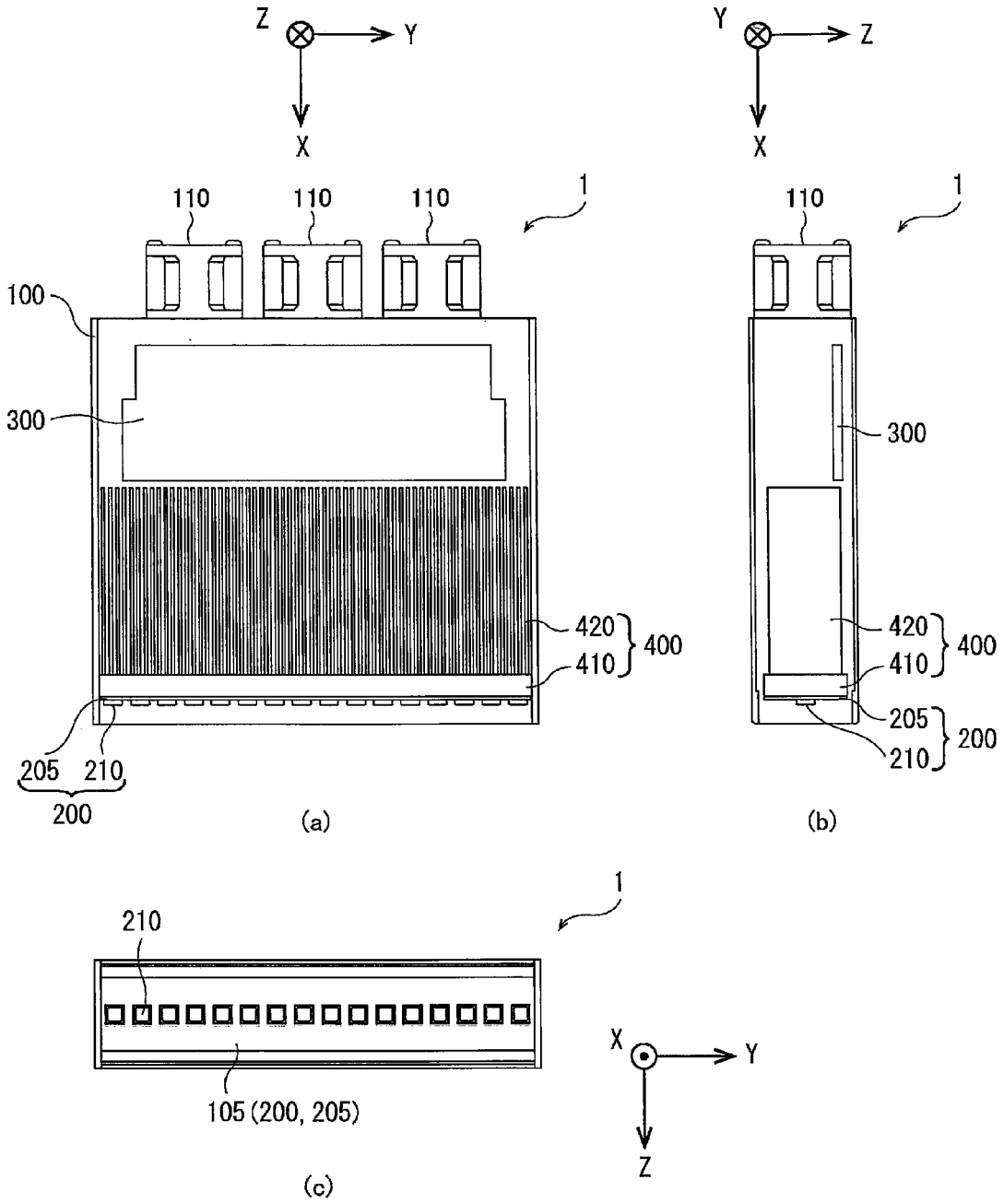
FIG. 2 is a diagram illustrating an internal configuration of the light emitting device according to an exemplary embodiment of the present disclosure.
Figure 3:
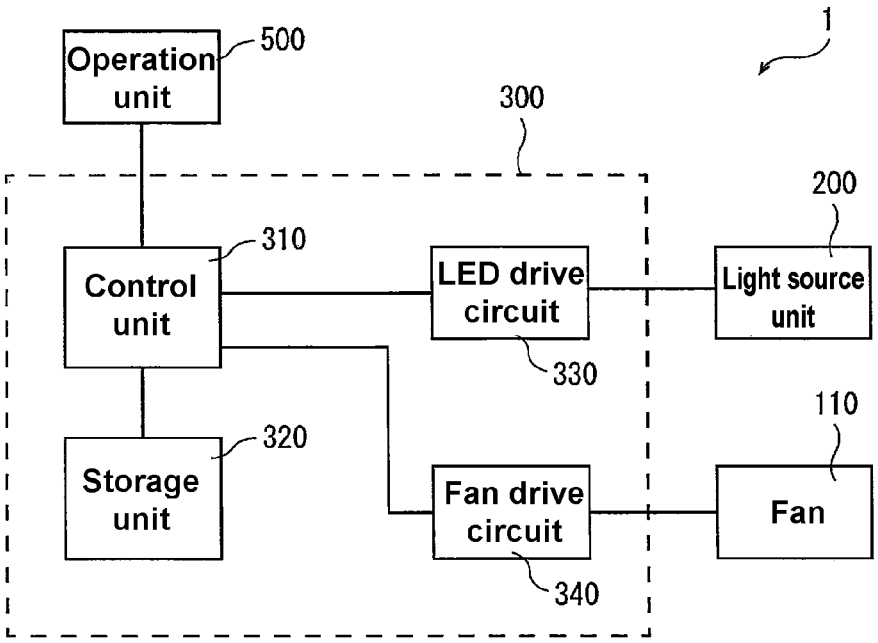
FIG. 3 is a block diagram illustrating an electrical connection of the internal configuration of the light emitting device according to an embodiment of the present disclosure.

FIG. 2 is a diagram illustrating an internal configuration of the light emitting device 1 according to an exemplary embodiment of the present disclosure, and FIG. 2(*a*) is a plan perspective view of the light emitting device 1. FIG. 2(*b*) is a right side perspective view of the light emitting device 1. FIG. 2(*c*) is a front perspective view of the light emitting device 1. In addition, FIG. 3 is a block diagram illustrating an electrical connection of the internal configuration of the light emitting device 1 according to an embodiment.

As shown in FIG. 2, the light emitting device 1 according to an exemplary embodiment is provided with the case 100 including the light source unit 200, a control substrate 300, and the heat sink member 400.

As shown in FIG. 2, the light source unit 200 includes a substrate 205 of a rectangular shape defined in the Y direction and the Z direction and sixteen LED elements 210 having the same property.

The sixteen LED elements 210 are arranged on a surface of the substrate 205 along a line to be spaced apart in a predetermined distance in the Y direction while the optical axis thereof is arranged in the X direction and electrically connected with the substrate 205. The substrate 205 is connected to an LED drive circuit 330 on the control substrate 300 through a cable (not shown), and a driving current from the LED drive circuit 330 is applied to each LED element 210 through the substrate 205 (refer to FIG. 3). When the driving current is applied to each LED element 210, an ultraviolet ray (e.g., wavelength of 365 nm) of the quantity of light depending on the driving current is emitted from each LED element 210, and an ultraviolet ray of a line shape which is parallel with the Y direction is emitted from the light source unit 200. Furthermore, the driving current applied to each LED element 210 is adjusted such that each LED element 210 of an exemplary embodiment emits an ultraviolet ray of about the same quantity of light, and the ultraviolet ray of a line shape emitted from the light source unit 200 has uniform distribution of quantity of light with respect to the Y direction. In addition, in an exemplary embodiment, a user manipulates an operation unit 500 (not shown in FIGS. 1 and 2) connected to the control substrate 300, and thus, the quantity of light of the ultraviolet ray emitted from the light source unit 200 may be adjusted (described in detail below).

The heat sink member 400 is a part of dissipating heat emitted from the light source unit 200. The heat sink member 400 according to an exemplary embodiment is disposed close to a rear surface of the substrate 205 of the light source unit 200 and includes a base plate 410 of a planar shape that conducts heat emitted from each LED element 210 and a heat sink fin 420 installed uprightly in a direction opposite to the X direction which dissipates heat transferred to the base plate 410 to air (refer to FIGS. 2(*a*) and (*b*)). When the fan 110 rotating air in the case 100 is exhausted from fan 110, external air is taken in from the intake hole 102. And then, an air current is generated such that the air taken in from the intake hole 102 flows on a surface of the heat sink fin 420, and thus, the heat sink fan 420 is efficiently cooled.

As shown in FIG. 3, the control substrate 300 is a circuit substrate that includes a control unit 310, a storage unit 320, the LED drive circuit 330, and a fan drive circuit 340 and controls the light source unit 200 and the fan 110.

The control unit 310 includes a CPU for executing a logical operation and a RAM that temporarily stores data and has the function of controlling the entire light emitting device 1. The control unit 310 is electrically connected to the storage unit 320, the LED drive circuit 330, the fan drive circuit 340, and the operation unit 500. When a power source is input to the light emitting device 1, the control unit 310 reads a control program stored in the storage unit 320 and controls each of the elements. That is, the control unit 310 according to an exemplary embodiment has both the function of controlling the LED drive circuit 330 (light source control unit) and the function of controlling the fan drive circuit 340 (fan control unit).

The storage unit 320 is a non-volatile memory that stores a control program executed in the control unit 310.

The operation unit 500 is a user interface in which an input from a user is performed and configured to set adjustment of a quantity of light of the ultraviolet ray emitted from the light source unit 220, turning on/off of the ultraviolet ray, and the like through the operation unit 500.

The LED drive circuit 330 is a circuit that is electrically connected to the light source unit 220 and supplies a driving current to each LED element 210. The LED drive circuit 330 turns on and off the LED element 210 and outputs a predetermined driving current to the LED element 210 according to an instruction (signal) from the control unit 310.

The fan drive circuit 340 is a circuit that is electrically connected to the fan 110 and supplies driving power to the fan 110. The fan drive circuit 340 turns on and off the fan 110 and rotates the fan 110 at a predetermined number of revolutions according to an instruction (signal) from the control unit 310.

Subsequently, with reference to the flowchart of FIG. 4, the control program executed in the control unit 310 is described. The control program is read from the storage unit 320 and executed in the control unit 310 when power source is input to the light emitting device 1. FIG. 5 is a timing chart corresponding to each step of the control program shown in FIG. 4 and illustrates the appearance of the light source unit 200 and the fan 110 in each step of the control program.

Figure 4:
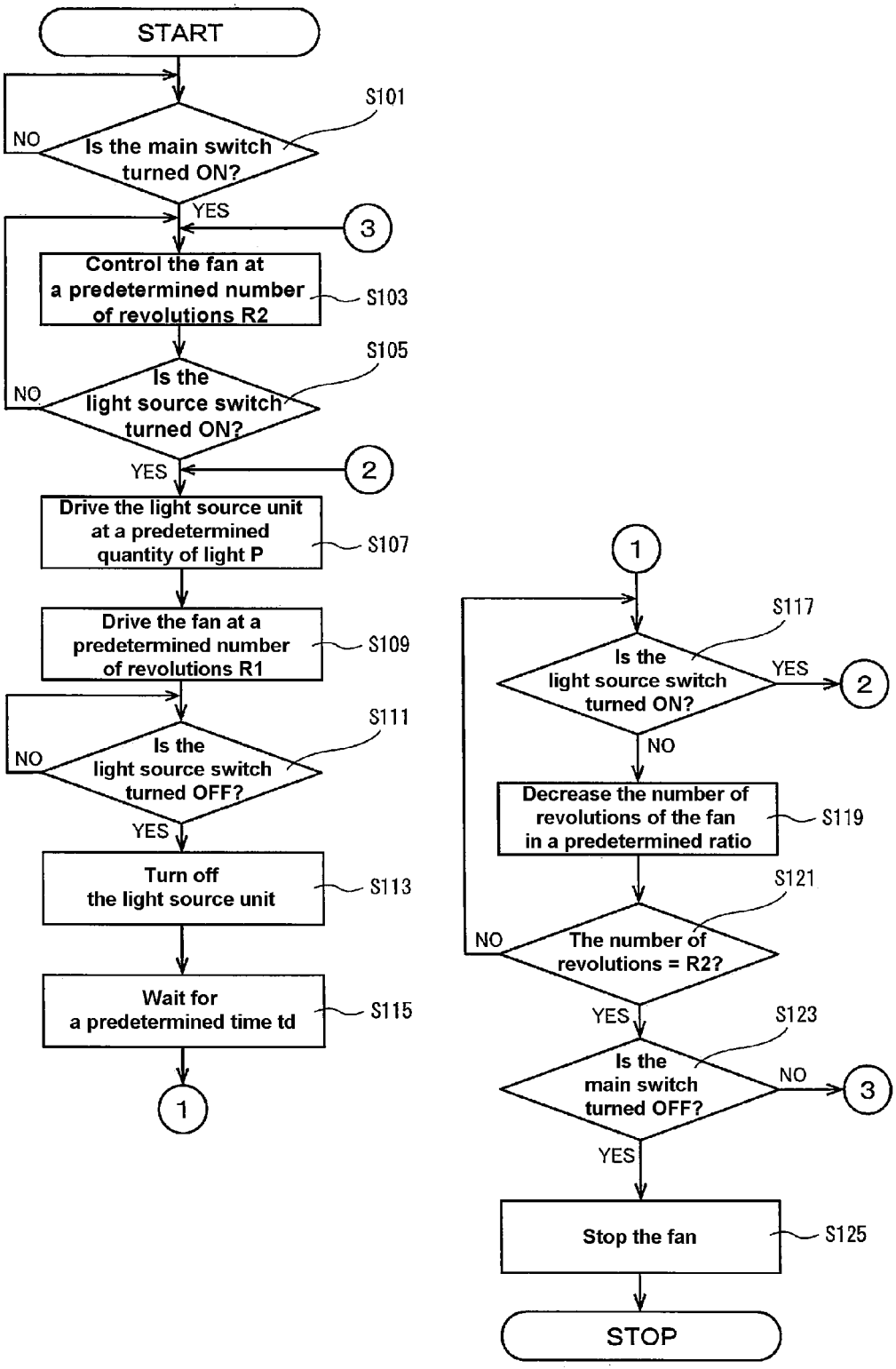
FIG. 4 is a flowchart of a control program executed in the light emitting device according to an exemplary embodiment of the present disclosure.
Figure 5:
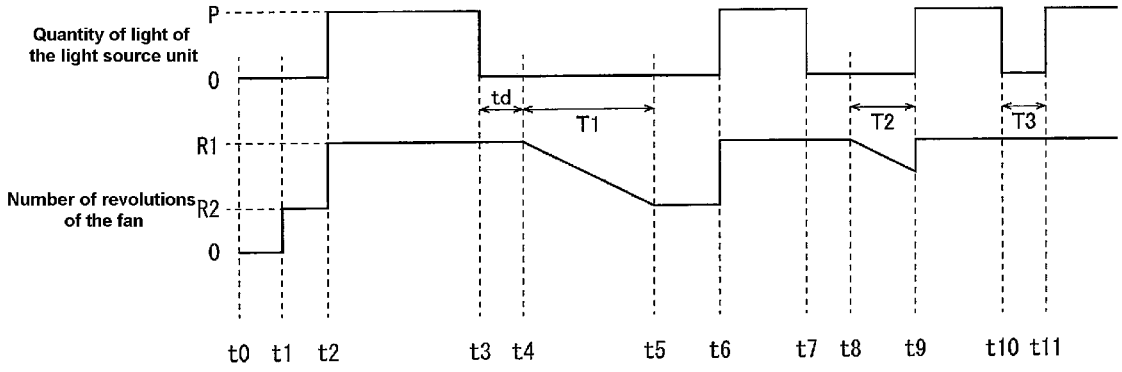
FIG. 5 is a timing chart corresponding to the flowchart shown in FIG. 4.

As shown in FIG. 4, when the control program is executed, the control unit 310 determines whether a user turns ON a main switch of the light emitting device 1 through the operation unit 500. In the case that it is determined that the main switch is not turned ON (step S101; NO), step S101 is repeated until the main switch is turned ON, and the light source unit 200 and the fan 110 maintain a state of OFF (i.e., the quantity of light of ultraviolet ray: 0 and the number of revolutions of the fan: 0) (t0~t1 of FIG. 5). In addition, when the main switch is turned ON (step S101; YES), the operation progresses to step S103.

In step S103, the control unit 310 controls the fan drive circuit 340 to drive the fan 110 at a predetermined number of revolutions R2 (e.g., 40% of the revolution per minute (rpm) of a maximum number of revolutions) (refer to FIG. 5; t1). When the operation of step S103 is terminated, the operation progresses to step S105.

In step S105, the control unit 310 determines whether a user turns ON a light source switch (a switch for functioning the light source unit 200) through the operation unit 500. In the case that it is determined that the light source switch is not turned ON (step S105; NO), steps S103 and S105 are repeated until the light source switch is turned ON (refer to FIG. 5; t1~t2), and in the case that light source switch is turned ON (step S105; YES), the operation progresses to step S107.

In step S107, the control unit 310 controls the LED drive circuit 330 to supply a driving current to each LED element 210 of the light source unit 200 such that the quantity of light of the ultraviolet ray emitted from the light source unit 200 becomes a predetermined quantity of light P (W) (refer to FIG. 5; t2). When the operation of step S107 is terminated, the operation progresses to step S109.

In step S109, the control unit 310 controls the fan drive circuit 340 to drive the fan 110 at a predetermined number of revolutions R1 which is higher than the number of revolutions R2 (e.g., 90% revolution per minute (rpm) of the maximum number of revolutions) (refer to FIG. 5; t2). In addition, in an exemplary embodiment, the number of revolutions R1 is set to the number of revolutions depending on the quantity of light P such that R1=a×P (a is an arbitrary constant). When the operation of step S109 is terminated, the operation progresses to step S111.

In step S111, the control unit 310 determines whether a user turns OFF the light source switch through the operation unit 500. In the case that it is determined that the light source switch is not turned OFF (step S111; NO), step S111 is repeated until the light source switch is turned OFF, and the light source unit 200 and the fan 110 maintain a state of ON (i.e., the quantity of light of ultraviolet ray: P and the number of revolutions of the fan: R1) (t2~t3 of FIG. 5). In addition, when the light source switch is turned OFF (step S111; YES), the operation progresses to step S113.

In step S113, the control unit 310 controls the LED drive circuit 330 to turn off the ultraviolet ray emitted from the light source unit 200 (refer to FIG. 5; t3). When the operation of step S113 is terminated, the operation progresses to step S115.

In step S115, the control unit 310 waits for a predetermined time td (e.g., 2 seconds) (refer to FIG. 5; t4), and the operation progresses to step S117.

In step S117, the control unit 310 determines whether a user turns ON the light source switch through the operation unit 500. In the case that it is determined that the light source switch is not turned ON (step S117; NO), the operation progresses to step S119. In the case that it is determined that the light source switch is turned ON (step S117; YES), the operation progresses to step S107.

In step S119, the control unit 310 controls the fan drive circuit 340 to drive the fan 110 such that the number of revolutions of the fan 110 is decreased in a predetermined ratio from the number of revolutions R1 to the number of revolutions R2 (refer to FIG. 5; t4~t5). That is, as shown in FIG. 5, in an exemplary embodiment, when a transition time of decreasing the number of revolutions from the number of revolutions R1 to the number of revolutions R2 is denoted as T (e.g., 10 seconds), the control unit 310 controls the fan drive circuit 340 to satisfy Conditional equation 1 below.

$(R2-R1)/T=k$ ($k$ is an arbitrary constant) [Conditional equation 1]

When the operation of step S119 is terminated, the operation progresses to step S121.

In step S121, the control unit 310 identifies a configuration of the fan drive circuit 340 and determines whether the number of revolutions of the fan 110 becomes the number of revolutions R2. In the case that the number of revolutions of the fan 110 is not the number of revolutions R2 (step S121; NO), steps S117 to S121 are repeated (refer to FIG. 5; t4~t5), and in the case that the number of revolutions of the fan 110 becomes the number of revolutions R2 (step S121; YES), the operation progresses to step S123 (refer to FIG. 5; t5).

In step S123, the control unit 310 determines whether a user turns OFF the main switch through the operation unit 500. In the case that it is determined that the main switch is not turned OFF (step S123; NO), the operation progresses to step S103, and in the case that it is determined that the main switch is turned OFF (step S123; YES), the control unit 310 stops the fan 110 (step S125) and terminates the control program.

As such, in the light emitting device 1 according to an exemplary embodiment (i.e., when the control program is executed), when a user turns ON the light source switch through the operation unit 500, the ultraviolet ray of a predetermined quantity of light P is emitted from the light source unit 200, and the fan 110 is driven at the number of revolutions R1 (refer to FIG. 5; t2~t3). Further, when the light source switch is turned OFF, after the ultraviolet ray is turned off, for a predetermined time td, the number of revolutions of the fan 110 is gradually decreased (refer to FIG. 5; t3~t5) and maintains the number of revolutions R2 (refer to FIG. 5; t5~t6). That is, since the fan 110 continuously rotates even when the ultraviolet ray is turned off, there is no case that the case 100 is full of heat. In addition, since the number of revolutions of the fan 110 is decreased in the waiting state after the ultraviolet ray is turned off, the risk of inhaling dust in the case 100 or the risk of reduction of life of the fan 100 becomes reduced.

Furthermore, in FIG. 5, the interval t6 to t9 denotes a time line in the case that a user turns ON the light source switch through the operation unit 500 when the number of revolutions of the fan 110 is decreasing in step S119. That is, in FIG. 4, while steps S117 to S121 are repeated (refer to FIG. 5; t8~t9), when turning ON of the light source switch is detected on time T2 which is shorter than the transition time T1, since the number of revolutions of the fan 110 is not decreased to the number of revolutions R2, the operation progresses to step S107 (step S117; YES). And then, the control unit 310 controls the LED drive circuit 330 to supply a driving current to each LED element 210 of the light source unit 200 such that the quantity of light of the ultraviolet ray emitted from the light source unit 200 becomes a predetermined quantity of light P (refer to FIG. 5; t9). As such, in an exemplary embodiment, when turning ON of the light source switch is detected during the transition time T1, the operation of steps S117 to S121 are stopped, and thus, the ultraviolet ray of a predetermined quantity of light P is emitted from the light source unit 200 and the fan 110 is driven at the number of revolutions R1 (refer to FIG. 5; t9).

In FIG. 5, the interval t9 to t11 denotes a time line in the case that a user turns ON the light source switch through the operation unit 500 when waiting for a predetermined time td in step S115. That is, in step S115 shown in FIG. 4, while waiting for a predetermined time td, when turning ON of the light source switch is detected, the operation progresses from step S117 to step S107 (i.e., there is not case of progressing to step S119). And then, the control unit 310 controls the LED drive circuit 330 to supply a driving current to each LED element 210 of the light source unit 200 such that the quantity of light of the ultraviolet ray emitted from the light source unit 200 becomes a predetermined quantity of light P (refer to FIG. 5; t11). As such, in an exemplary embodiment, when turning ON of the light source switch is detected while waiting for a predetermined time td (during the period of T3), the operations of steps S117 to S121 are not performed (i.e., the number of revolutions of the fan 110 is not decreased), and thus, the ultraviolet ray of a predetermined quantity of light P is emitted from the light source unit 200 and the fan 110 is driven to maintain the number of revolutions R1 (refer to FIG. 5; t11).

So far, the exemplary embodiment has been described, but the present disclosure is not limited to the configuration described above, and various modifications are available within the scope of the inventive concept of the present disclosure. For example, in step S109 of the exemplary embodiment, the number of revolutions R1 is configured as is R1=a×P (a is an arbitrary constant) (i.e., the number of revolutions R1 is in the relationship of proportional to the quantity of light P) but may be generalized to a linear function as represented in Conditional equation 2.

$R1=a\cdot P+b$ ($a$ and $b$ are arbitrary constants) [Conditional equation 2]

The number of revolutions R1 and the quantity of light P are not necessarily in a proportional relationship, and the number of revolutions R1 may be set to a predetermined number of revolutions.

In the exemplary embodiment, it has been described that the number of revolutions R2 is 40% of the maximum number of revolutions, but the present disclosure is not limited thereto, and the number of revolutions R2 may be properly set according to the heat value of the light source unit 200 and the cooling capacity of the heat sink member 400 or the fan 110.

In addition, in step S115 according to the exemplary embodiment, it has been described that the control unit 310 waits for a predetermined time td (e.g., 2 seconds), but the present disclosure is not limited thereto, and the predetermined time td may be properly set according to the heat value of the light source unit 200 and the cooling capacity of the heat sink member 400 or the fan 110.

The light emitting device 1 according to the exemplary embodiment has been described that the heat sink member 400 is disposed in the case 100, but the light source unit 200 may be cooled down by the fan 110, and thus, the heat sink member 400 is optional.

FIRST MODIFIED EXAMPLE

Figure 6:
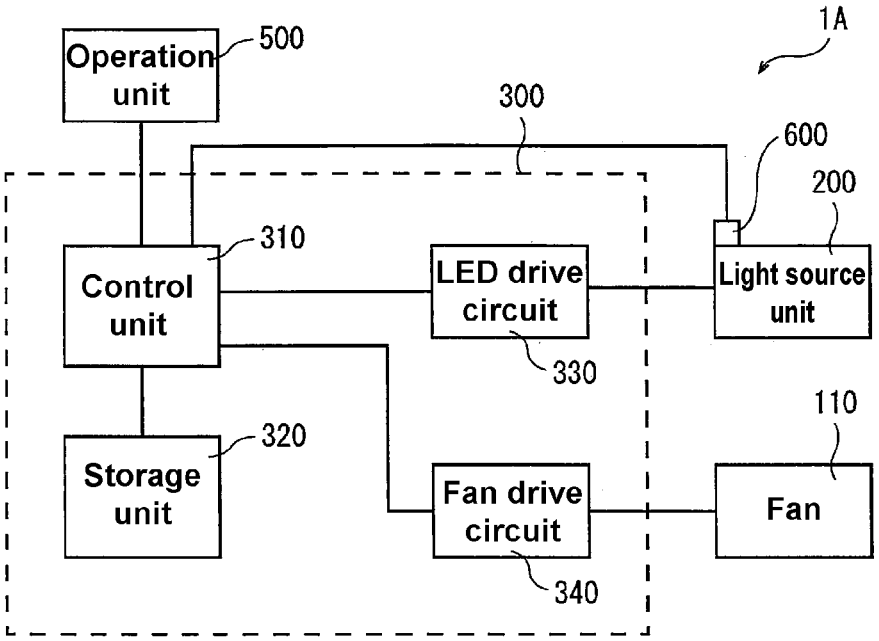
FIG. 6 is a block diagram illustrating an electrical connection of the internal configuration of a light emitting device according to a first modified example of the present disclosure.
Figure 7:
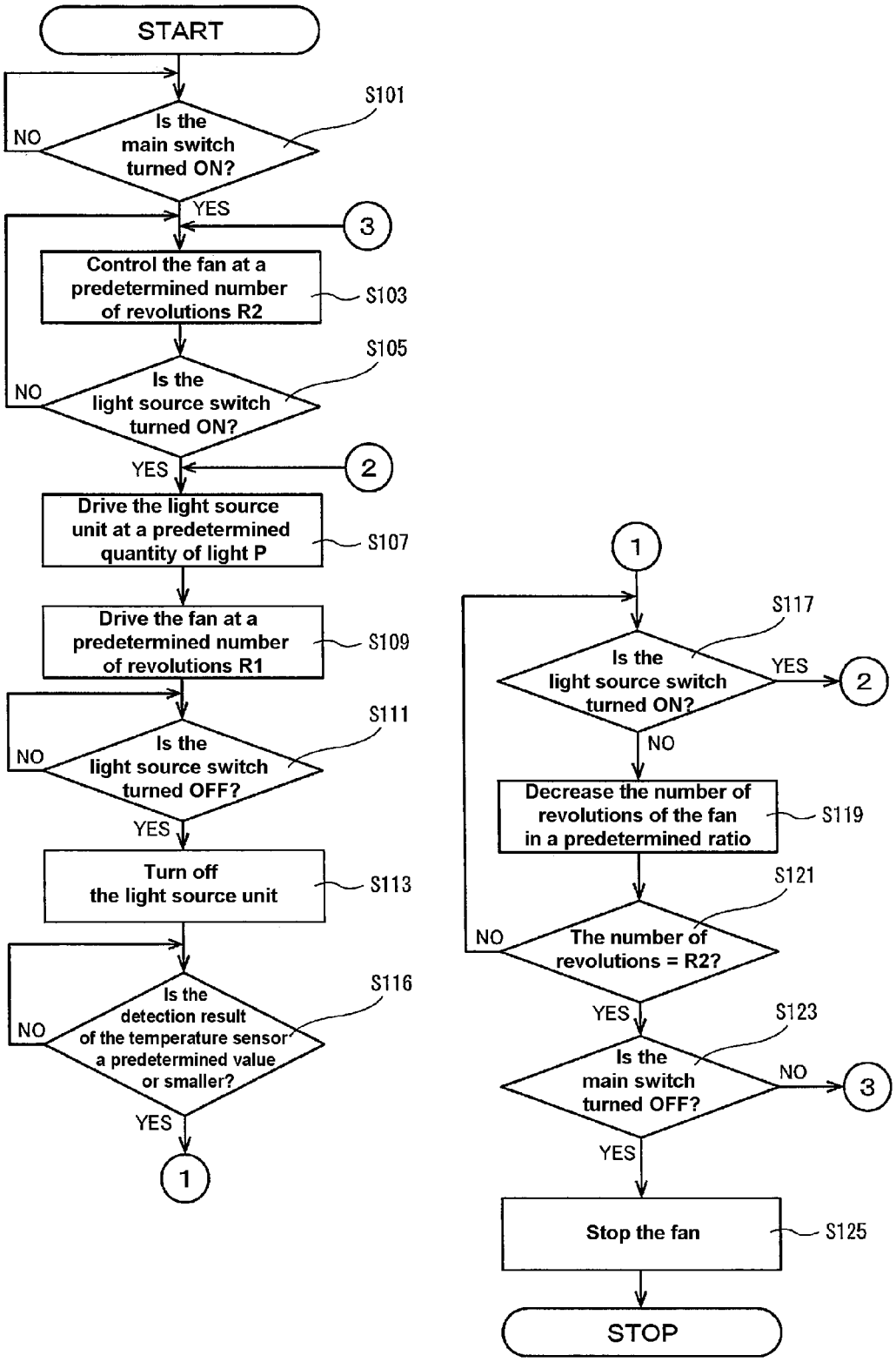
FIG. 7 is a flowchart of a control program executed in the light emitting device according to the modified example of the present disclosure.

FIG. 6 is a block diagram illustrating an electrical connection of the internal configuration of a light emitting device 1A according to a first modified example. In addition, FIG. 7 is a flowchart of a control program executed in the control unit 310 of the modified example.

As shown in FIG. 6, the light emitting device 1A according to the modified example is different from the configuration of the exemplary embodiment in the fact that the light emitting device 1A has a temperature sensor 600 that detects a temperature of the light source unit 200 and has step S116 instead of step S115 of the control program of the exemplary embodiment.

That is, in the modified example, after the light source switch is turned OFF (steps S111 and S113), the control unit 310 waits until a detection result of the temperature sensor 600 becomes a predetermined value (e.g., 40°) or smaller (step S116; NO), and when the detection result of the temperature sensor 600 becomes the predetermined value or smaller, the control unit 310 decreases the number of revolutions of the fan 110 gradually (steps S117 S121). As such, according to the modified example, the number of revolutions of the fan 110 is controlled based on the detection result of the temperature sensor 600, and the light source unit 200 may be properly cooled down.

SECOND MODIFIED EXAMPLE

Figure 8:
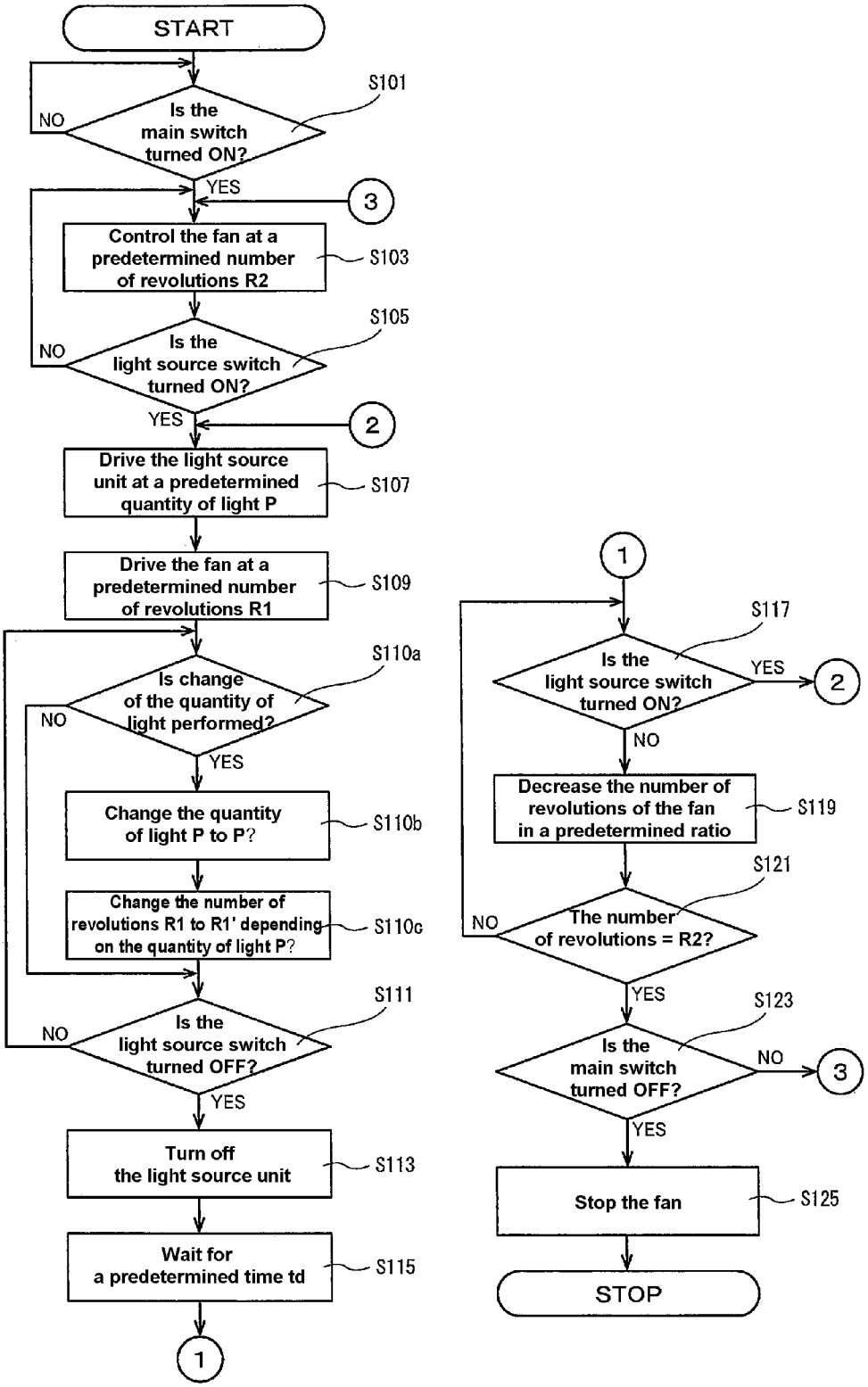
FIG. 8 is a flowchart of a control program executed in a light emitting device according to a second modified example of the present disclosure.
Figure 9:
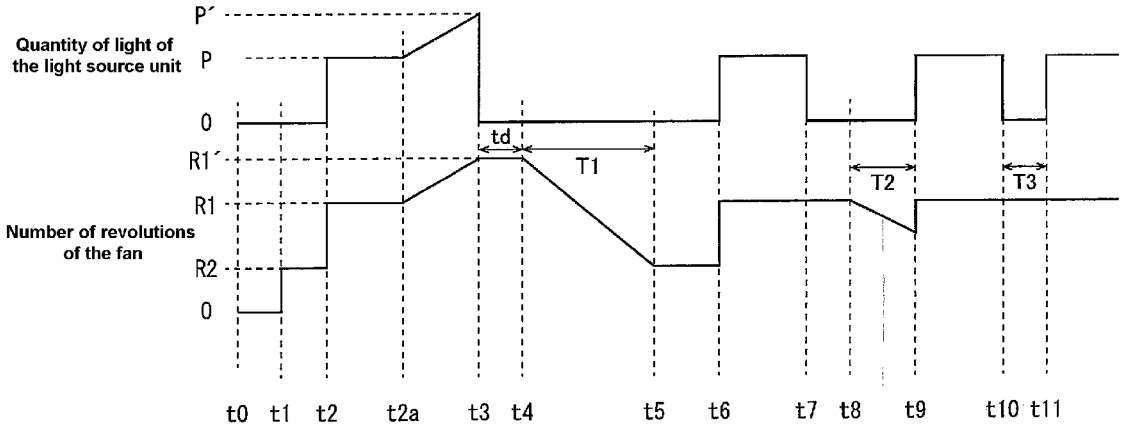
FIG. 9 is a timing chart corresponding to the flowchart shown in FIG. 8.

FIG. 8 is a flowchart of a control program executed in the control unit 310 of a light emitting device 1B (not shown in FIG. 8) according to a second modified example. In addition, FIG. 9 is a timing chart corresponding to each step of the control program shown in FIG. 8, which shows the feature of the light source unit 200 and the fan 110 in each step of the control program. The configuration of the light emitting device 1B according to the second modified example is the same as the light emitting device 1 of the exemplary embodiment, but only the control program is different.

As shown in FIG. 8, the control program of the light emitting device 1B according to the modified example is different from the control program of the light emitting device 1 of the exemplary embodiment in the fact that the control program of the light emitting device 1B has steps S110*a*, S110*b*, and S110*c* between step S109 and step S101.

In step S110*a*, the control unit 310 determines whether a user manipulates a change of the quantity of light through the operation unit 500 (i.e., whether a user manipulates the quantity of light P to be changed). When it is determined that a manipulation of changing the quantity of light is not performed (step S110*a*: NO), the operation progresses to step S111, and when it is determined that a manipulation of changing the quantity of light is performed (step S110*a*: YES), the operation progresses to step S110*b*.

In step S110*b*, the control unit 310 controls the LED drive circuit 330 based on a user manipulation which is input to the operation unit 500 to supply a driving current to each LED element 210 of the light source unit 200 such that the ultraviolet ray emitted from the light source unit 200 becomes a predetermined quantity of light P' (P' is a quantity of light after change) (refer to FIG. 9; t2*a*). When the operation of step S110*b* is terminated, the operation is processing to step S110*c*.

In step S110*c*, the control unit 310 controls the fan drive circuit 340 according to the quantity of light P' in step S110*b* to change the number of revolutions R1 of the fan 110 to the number of revolutions R1' (refer to FIG. 9; t2*a*). That is, the number of revolutions is changed such that the number of revolutions R1 becomes R1'=a×P' (a is an arbitrary constant). When the operation of step S110*c* is terminated, the operation is processing to step S111.

In step S111, the control unit 310 determines whether a user turns OFF the light source switch through the operation unit 500. In the case that it is determined that the light source switch is not turned OFF (step S111; NO), the operation returns to step S109, and steps S110*a* to S110*c* are repeated (refer to FIG. 9; t2*a*~t3). In addition, when the light source switch is turned OFF (step S111; YES), the operation progresses to step S113.

As such, in the light emitting device 1B according to the modified example, when a user manipulates a change of the quantity of light through the operation unit 500, the quantity of light P is changed according to the user manipulation and depending on the quantity of light P' which is changed, the number of revolutions R1 is also changed to the number of revolutions R1' (refer to FIG. 9; t2*a*~t3). Further, when the light source switch is turned OFF, after the ultraviolet ray is turned off, by waiting for a predetermined time td, the number of revolutions of the fan 110 is gradually decreased (refer to FIG. 9; t3~t5) and maintains the number of revolutions R2 (refer to FIG. 9; t5~t6). That is, since the fan 110 continuously rotates even when the ultraviolet ray is turned off, there is no case that the case 100 is full of heat. In addition, since the number of revolutions of the fan 110 is decreased in the waiting state after the ultraviolet ray is turned off, the risk of inhaling dust in the case 100 or the risk of reduction of life of the fan 100 becomes reduced.

The exemplary embodiments disclosed so far are just exemplary for all aspects and are not intended to be restrictive. The scope of the present disclosure is interpreted by the claims, not by the description above, and it is intended to include all modifications in the equivalent meaning and scope of the claims.

DETAILED DESCRIPTION OF MAIN ELEMENTS

1: light emitting device
1A: light emitting device
1B: light emitting device
100: case
102: intake hole
105: window part
110: fan
200: light source unit
205: substrate
210: LED element
300: control substrate
310: control unit
320: storage unit
330: LED drive circuit
340: fan drive circuit
400: heat sink member
410: base plate
420: heat sink fin
500: operation unit
600: temperature sensor

What is claimed is:

1. A light source device comprising:
a light source;
a light source control unit for controlling turning on/off and a quantity of light of the light source;
a cooling fan for cooling the light source; and
a fan control unit for controlling a number of revolutions of the cooling fan,
wherein the fan control unit is configured to:

control the number of revolutions of the cooling fan to become a first number of revolutions depending on the quantity of light of the light source when the light source is turned on, and control the number of revolutions of the cooling fan to become a second number of revolutions lower than the first number of revolutions by waiting for a predetermined waiting time when the light source is turned off.

2. A light source device comprising:

a light source;

a light source control unit for controlling turning on/off of the light source;

a cooling fan for cooling the light source; and a fan control unit for controlling a number of revolutions of the cooling fan based on turning on/off of the light source, wherein the fan control unit is configured to:

control the number of revolutions of the cooling fan to become a first number of revolutions when the light source is turned on, and control the number of revolutions of the cooling fan to become a second number of revolutions lower than the first number of revolutions by waiting for a predetermined waiting time when the light source is turned off.

3. A light source device comprising:

a light source;

a light source control unit for controlling turning on/off of the light source;

a temperature sensor for detecting a temperature of the light source;

a cooling fan for cooling the light source; and a fan control unit for controlling a number of revolutions of the cooling fan based on turning on/off of the light source and a detection result of the temperature sensor, wherein the fan control unit is configured to:

control the number of revolutions of the cooling fan to become a first number of revolutions when the light source is turned on, and control the number of revolutions of the cooling fan to become a second number of revolutions lower than the first number of revolutions by waiting until the detection result of the temperature sensor becomes a predetermined value or smaller when the light source is turned off.

4. The light source device of claim 1, wherein the fan control unit controls the number of revolutions of the cooling fan to satisfy Conditional equation 1 below when the first number of revolutions is R1, the second number of revolutions is R2, and a transition time from the first number of revolutions to the second number of revolutions is T, $(R2-R1)/T=k$ ($k$ is an arbitrary constant) [Conditional equation 1]

5. The light source device of claim 4, wherein, when the light source is turned on within the transition time, the fan control unit does not wait for the transition time to be lapsed and controls the cooling fan such that the number of revolutions of the cooling fan becomes the first number of revolutions.

6. The light source device of claim 1, wherein the fan control unit controls the number of revolutions of the cooling fan to satisfy Conditional equation 2 below when the first number of revolutions is R1 and the quantity of light of the light source is P, $R1=a\cdot P+b$ ($a$ and $b$ are arbitrary constants) [Conditional equation 2]

7. The light source device of claim 1, wherein the second number of revolutions is set to about 40% of a maximum number of revolutions of the cooling fan.

8. The light source device of claim 2, wherein the fan control unit controls the number of revolutions of the cooling fan to satisfy Conditional equation 1 below when the first number of revolutions is R1, the second number of revolutions is R2, and a transition time from the first number of revolutions to the second number of revolutions is T, $(R2-R1)/T=k$ ($k$ is an arbitrary constant) [Conditional equation 1]

9. The light source device of claim 3, wherein the fan control unit controls the number of revolutions of the cooling fan to satisfy Conditional equation 1 below when the first number of revolutions is R1, the second number of revolutions is R2, and a transition time from the first number of revolutions to the second number of revolutions is T, $(R2-R1)/T=k$ ($k$ is an arbitrary constant) [Conditional equation 1]

10. The light source device of claim 8, wherein, when the light source is turned on within the transition time, the fan control unit does not wait for the transition time to be lapsed and controls the cooling fan such that the number of revolutions of the cooling fan becomes the first number of revolutions.

11. The light source device of claim 9, wherein, when the light source is turned on within the transition time, the fan control unit does not wait for the transition time to be lapsed and controls the cooling fan such that the number of revolutions of the cooling fan becomes the first number of revolutions.

12. The light source device of claim 2, wherein the fan control unit controls the number of revolutions of the cooling fan to satisfy Conditional equation 2 below when the first number of revolutions is R1 and the quantity of light of the light source is P, $R1=a\cdot P+b$ ($a$ and $b$ are arbitrary constants) [Conditional equation 2]

13. The light source device of claim 3, wherein the fan control unit controls the number of revolutions of the cooling fan to satisfy Conditional equation 2 below when the first number of revolutions is R1 and the quantity of light of the light source is P, $R1=a\cdot P+b$ ($a$ and $b$ are arbitrary constants) [Conditional equation 2]

14. The light source device of claim 2, wherein the second number of revolutions is set to about 40% of a maximum number of revolutions of the cooling fan.

15. The light source device of claim 3, wherein the second number of revolutions is set to about 40% of a maximum number of revolutions of the cooling fan.

* * * * *